US010553151B2

(12) United States Patent
Xu et al.

(10) Patent No.: US 10,553,151 B2
(45) Date of Patent: Feb. 4, 2020

(54) CURRENT CONTROL METHOD AND APPARATUS THEREOF

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Haixia Xu, Beijing (CN); Wenchao Bao, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhul (CN)

( * ) Notice: Subject to any disclaimer, the term of this patent is extended or adjusted under 35 U.S.C. 154(b) by 76 days.

(21) Appl. No.: 15/983,939

(22) Filed: May 18, 2018

(65) Prior Publication Data

US 2019/0164471 A1 May 30, 2019

(30) Foreign Application Priority Data

Nov. 27, 2017 (CN) ..... 2017 1 1213410

(51) Int. Cl.
*G09G 3/3208* (2016.01)
*G09G 3/20* (2006.01)

(52) U.S. Cl.
CPC ..... *G09G 3/3208* (2013.01); *G09G 3/2007* (2013.01); *G09G 2320/041* (2013.01); *G09G 2320/046* (2013.01); *G09G 2320/0626* (2013.01); *G09G 2360/16* (2013.01)

(58) Field of Classification Search
CPC ..... G09G 2320/041; G09G 2320/046; G09G 2320/0626; G09G 2320/0693; G09G 2360/16; G09G 3/2007; G09G 3/2092; G09G 3/3208
See application file for complete search history.

(56) References Cited

U.S. PATENT DOCUMENTS

2016/0148564 A1* 5/2016 Kim ..... G09G 3/3233 345/211

* cited by examiner

*Primary Examiner* — Dmitriy Bolotin
(74) *Attorney, Agent, or Firm* — Kinney & Lange, P.A.

(57) ABSTRACT

Embodiments of the present disclosure disclose a current control method and an apparatus thereof. The current control method includes: generating a correspondence between grayscale brightness and a current of a display panel; detecting, in a blank interval of a display period, an actual current value and an actual grayscale brightness of the display panel; determining a target current value by looking up a correspondence between the grayscale brightness and the current according to a target grayscale brightness of the display panel; and adjusting, based on a comparison of the actual current value and the target current value, the actual grayscale brightness so that the actual current value is less than or equal to the target current value.

16 Claims, 3 Drawing Sheets

CURRENT CONTROL METHOD AND APPARATUS THEREOF

CROSS-REFERENCE TO RELATED APPLICATION

This application claims priority of a Chinese patent application No. 201711213410.4 filed to SIPO on Nov. 27, 2017, the entire contents of which are incorporated herein by reference.

TECHNICAL FIELD

Embodiments of the present disclosure relate to the field of display technology, and in particular to a current control method and an apparatus thereof.

BACKGROUND

Organic Light-Emitting Diode (OLED) technology is one of the hot topics in the field of flat panel display panels.

SUMMARY

Embodiments of the present disclosure provide a current control method and an apparatus thereof, which are applied in a display panel.

In one aspect, an embodiment of the present disclosure provides a current control method which includes:

generating a correspondence between grayscale brightness and a current of a display panel;

detecting, in a blank interval of a display period, an actual current value and an actual grayscale brightness of the display panel;

determining a target current value by looking up the correspondence between the grayscale brightness and the current according to a target grayscale brightness of the display panel;

adjusting, based on a comparison of the actual current value and the target current value, the actual grayscale brightness so that the actual current value is less than or equal to the target current value.

Optionally, generating a correspondence between grayscale brightness and a current includes:

detecting a current value corresponding to a preset grayscale value;

calculating grayscale brightness corresponding to a preset grayscale value;

generating, according to the current value corresponding to the preset grayscale value and the grayscale brightness corresponding to the preset grayscale value, the correspondence between the grayscale brightness and the current by means of linear fitting.

Optionally, detecting, in a blank interval of a display period, an actual current value and an actual grayscale brightness of the display panel includes:

detecting, in a blank interval of a display period, the actual current value and the actual grayscale brightness of the display panel every preset interval.

Optionally, adjusting, based on a comparison of the actual current value and the target current value, the actual grayscale brightness includes:

adjusting the actual grayscale brightness to a product of the actual grayscale brightness and a first ratio in a state where the actual current value is greater than the target current value, wherein the first ratio is greater than 0 and less than 1.

Optionally, adjusting, based on a comparison of the actual current value and the target current value, the actual grayscale brightness includes:

adjusting the actual grayscale brightness to a product of the actual grayscale brightness and a second ratio in a state where the actual current value is less than the target current value, wherein the second ratio is greater than 0 and less than 1, and wherein the second ratio is greater than the first ratio.

Optionally, the number of preset grayscale values is two or more.

Optionally, the display panel is an OLED display panel.

Optionally, generating the correspondence between the grayscale brightness and the current of the display panel further includes: generating correspondences between the grayscale brightness and the current for each of at least three colors. Detecting an actual current value and an actual grayscale brightness of the display panel includes: obtaining the actual current value and the actual grayscale brightness for each color, and summing the actual current value and the actual grayscale brightness for each color to obtain the actual current value and the actual grayscale brightness of the display panel. Determining a target current value by looking up the correspondence between the grayscale brightness and the current according to a target grayscale brightness of the display panel includes: determining the target current value of the display panel by looking up the correspondence between the grayscale brightness and the current for each color to obtain a target current value for each color, and summing the target current values for each color.

In another aspect, embodiments of the present disclosure further provide a current control apparatus, including a presetting circuit configured to generate a correspondence between grayscale brightness and a current of a display panel;

a detection circuit configure to detect, in a blank interval of a display period, an actual current value and an actual grayscale brightness of the display panel;

a determination circuit configured to determine a target current value by looking up a correspondence between the grayscale brightness and the current according to a target grayscale brightness of the display panel;

a comparison circuit configured to compare the actual current value and the target current value;

an adjustment circuit configured to adjust, based on a comparison of the actual current value and the target current value, the actual grayscale brightness so that the actual current value is less than or equal to the target current value.

Optionally, the presetting circuit is particularly configured to generate a correspondence between grayscale brightness and a current by: detecting a current value corresponding to a preset grayscale value; calculating grayscale brightness corresponding to a preset grayscale value; generating, according to the current value corresponding to the preset grayscale value and the grayscale brightness corresponding to the preset grayscale value, the correspondence between the grayscale brightness and the current by means of linear fitting.

Optionally, the detection circuit is particularly configured to detect, in a blank interval of a display period, an actual current value and an actual grayscale brightness of the display panel every preset interval.

Optionally, the adjustment circuit is particularly configured to adjust the actual grayscale brightness to a product of the actual grayscale brightness and a first ratio in a state where the actual current value is greater than the target current value, wherein the first ratio is greater than 0 and less than 1.

Optionally, the adjustment circuit is particularly configured to adjust the actual grayscale brightness to a product of the actual grayscale brightness and a second ratio in a state where the actual current value is less than the target current value, wherein the second ratio is greater than 0 and less than 1, and wherein the second ratio is greater than the first ratio.

Optionally, the display panel is an OLED display panel.

Optionally, the presetting circuit is further configured to generate correspondences between the grayscale brightness and the current for each of at least three colors. The detection circuit is further configured to obtain the actual current value and the actual grayscale brightness for each color, and sum the actual current value and the actual grayscale brightness for each color to obtain the actual current value and the actual grayscale brightness of the display panel. The determination circuit is further configured to determine the target current value of the display panel by determining the target current value for each color by looking up the correspondence between the grayscale brightness and the current for each color, and summing the target current values for each color.

Additional features and advantages of the present disclosure will be set forth in the following embodiments of the description, and will become apparent from the description of the embodiments, or be learned through the implementation of the disclosure. The objectives and other advantages of the embodiments of the present disclosure can be achieved and obtained by the structures specifically pointed out in the description, the claims, and the drawings.

BRIEF DESCRIPTION OF THE DRAWINGS

The accompanying drawings are used to provide a further understanding of the technical solutions of the present disclosure and constitute a part of the description. They are used together with embodiments of the present application to explain the technical solutions of the present disclosure, and do not limit the technical solutions of the present disclosure.

DETAILED DESCRIPTION

To make the objectives, technical solutions, and advantages of the present disclosure clearer, the embodiments of the present disclosure will be described below in detail with reference to the accompanying drawings. It should be noted that, in the absence of any conflict, the embodiments in the present application and features in the embodiments may be combined with each other arbitrarily.

Technical terms or scientific terms used in the embodiments of the present disclosure should have the meanings understood by those of ordinary skill in the field to which the present disclosure belongs, unless defined otherwise. Words "first", "second", and the like used in the embodiments of the present disclosure do not indicate any order, quantity, or importance, but are only used to distinguish different components. Words such as "comprise" or "include" and the like, means that components or items preceding the word cover components or items listed after the word and the equivalent thereof, without excluding other components or items. Words such as "connecting" or "connected" and the like are not limited to physical or mechanical connections, but may include electrical connections, whether direct or indirect.

In the embodiments described below, a communication connection includes a connection through a wireless network, a wired network, and/or any combination of a wireless network and a wired network. A network may include a local area network, the Internet, a telecommunications network, an internet of things based on the Internet and/or a telecommunication network, and/or any combination of the above networks. The wired network may use, for example, a conductive line, a twisted pair, a coaxial cable, or an optical fiber transmission to transmit information, while the wireless network may use, for example, a WWAN mobile communication network, Bluetooth, Zigbee, or WiFi.

The inventor has studied and found the following facts: during the display period of an OLED display panel, since the OLED is a current mode device, when a large current flows through the display panel, the temperature will increase, and the temperature rise will cause the current value to further increase. Furthermore, in the reliability test of the OLED display panel, when the OLED display panel is put into a high temperature oxide film chamber, the temperature rise will also cause the current value to further increase, and the excessive current value will cause the OLED display panel to burn its screen. This phenomenon, and a control method to deal with it, will be explained below by taking an OLED display panel as an example. However, it is obvious to those skilled in the art that the technical solutions according to the embodiments of the present disclosure may, of course, be applied to other display panels, particularly display panels having a relationship between current values and temperatures like that of the OLED display panel.

Figure 1:
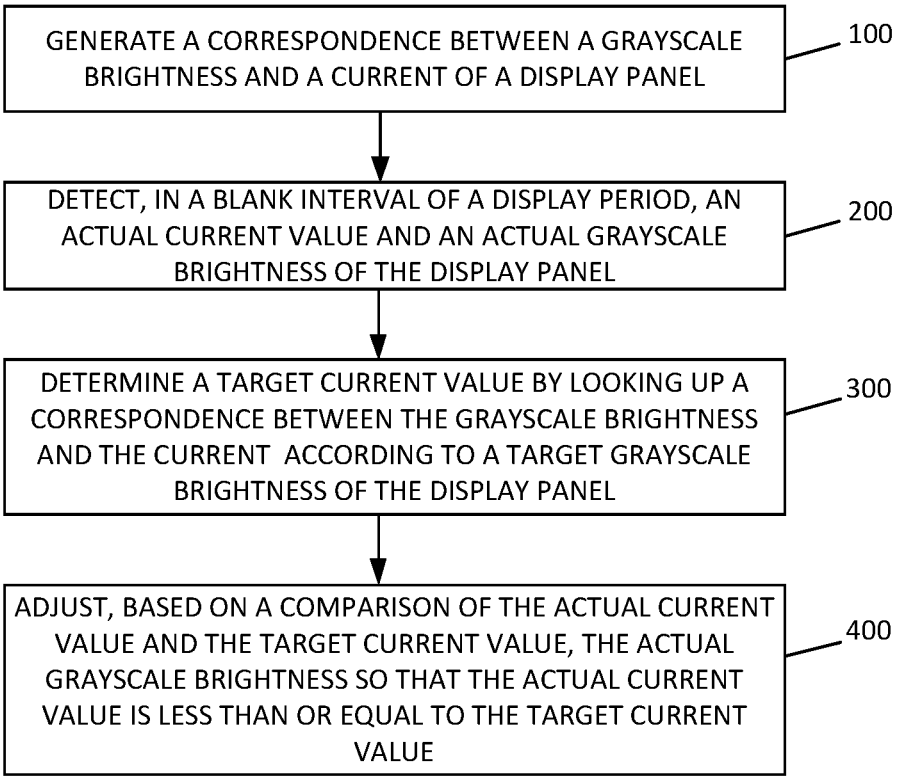
FIG. 1 is a flowchart of a current control method in accordance with an embodiment of the present disclosure.

FIG. 1 is a flowchart of a current control method in accordance with an embodiment of the present invention. The current control method in accordance with an embodiment of the present disclosure is applied to an organic light emitting diode (OLED) display panel. Particularly, as shown in FIG. 1, the current control method in accordance with an embodiment of the present disclosure includes the following steps:

Step 100: generating a correspondence between grayscale brightness and a current of the display panel.

Figure 2:
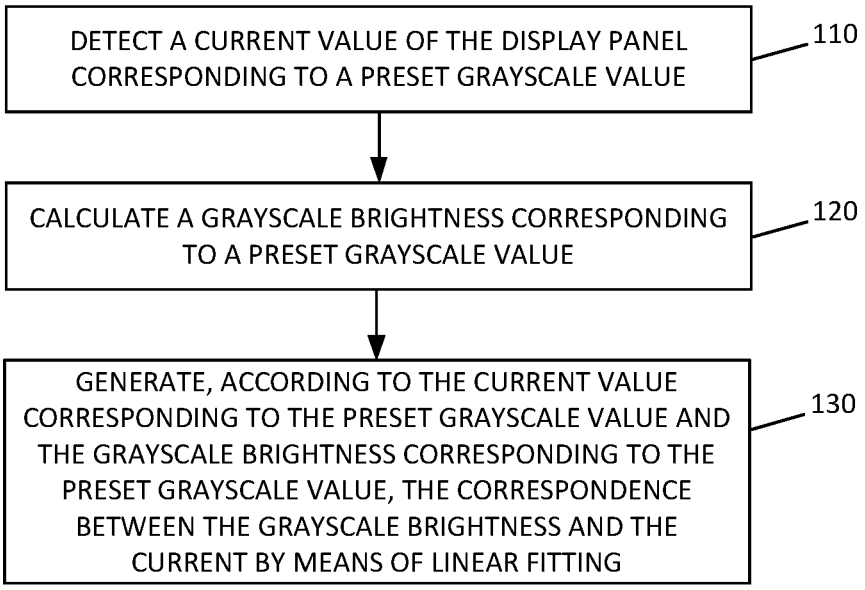
FIG. 2 is a flowchart of step 100 in accordance with an embodiment of the present disclosure.

Particularly, FIG. 2 is a flowchart of step 100 in accordance with an embodiment of the present disclosure. As shown in FIG. 2, step 100 particularly includes:

Step 110, detecting a current value of the display panel corresponding to a preset grayscale value.

Optionally, the number of preset grayscale values is two or more. It should be noted that the greater the number of the preset grayscale values is, the higher the accuracy of the detection is. Taking 1024-level grayscales as an example, the number of the preset grayscale values may be four, for example, and the preset grayscale values may be respectively selected as: 132, 346, 542, and 1023. The present disclosure does not particularly define the number and specific values of the preset grayscale values.

Particularly, a current value corresponding to a preset grayscale value is detected by an INA226 chip.

Step 120, calculating grayscale brightness corresponding to a preset grayscale value.

Particularly, each preset grayscale value corresponds to one grayscale brightness, and the grayscale brightness corresponding to a preset grayscale value is determined according to the preset grayscale value and the number of grayscales. That is, the grayscale brightness corresponding to the preset grayscale value is equal to the ratio of the preset grayscale value to the number of grayscales. For example, if the OLED display panel adopts 10-level grayscales, the number of grayscales is 210. In this case, if the preset grayscale value is selected as 132, then the grayscale brightness corresponding to the preset grayscale value is 132/210.

Step 130, generating, according to the current value corresponding to the preset grayscale value and the grayscale brightness corresponding to the preset grayscale value, the correspondence between the grayscale brightness and the current by means of linear fitting.

Particularly, the grayscale brightness is linearly related to a corresponding current value, and the correspondence between the grayscale brightness and the current can be uniquely determined according to two or more grayscale brightness and currents.

In a particular embodiment, the OLED display panel may include a plurality of sub-pixels displaying at least three colors. Alternatively, if the number of colors is three, the three colors may include: red, blue, and green, i.e, the tricolor. If the number of colors is four, the four colors may include: red, blue, green and white. In addition, the use of four colors, instead of three colors, can reduce the power consumption of the current detection.

In this embodiment, step 100 further includes: generating correspondences between the grayscale brightness and the current for each of at least three colors. Particularly, step 110 includes: detecting a current value corresponding to the preset grayscale value for each of the at least three colors respectively. Step 120 includes calculating grayscale brightness corresponding to a preset grayscale value for each color. Step 130 includes generating, according to the current value corresponding to the preset grayscale value for each color and the grayscale brightness corresponding to the preset grayscale value, the correspondence between the grayscale brightness and the current for each color by means of linear fitting.

In a particular embodiment, step 100 further includes: summing the generated correspondences between the grayscale brightness and the current for each of the at least three colors, so as to obtain a correspondence between the grayscale brightness and the current for a mixed color. For example, a current value corresponding to specific grayscale brightness for each color is summed to obtain a current value corresponding to the specific grayscale brightness, thereby obtaining a correspondence between the grayscale brightness and the current for the mixed color. The correspondence between the grayscale brightness and the current for the mixed color can be used as the correspondence between the grayscale brightness and the current of the OLED display panel displaying a color image.

Figure 3:
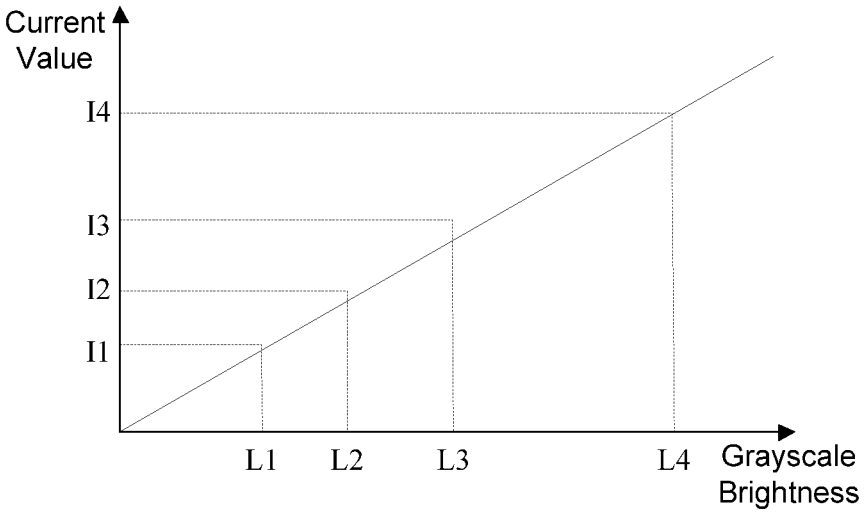
FIG. 3 illustrates the correspondence between grayscale brightness and a current for one color in accordance with an embodiment of the present disclosure.

FIG. 3 illustrates the correspondence between grayscale brightness and a current for one color in accordance with an embodiment of the present disclosure. FIG. 3 is illustrated by using four preset grayscale values as examples. Four corresponding grayscale brightness L1, L2, L3, and L4 are calculated and obtained according to the four preset grayscale values, and four corresponding current values I1, I2, I3, and I4 are acquired, and then the correspondence between the grayscale brightness and the current for this color that is formed by means of linear fitting is shown in FIG. 3.

Step 200, detecting, in a blank interval of a display period, an actual current value and an actual grayscale brightness of the OLED display panel.

In a particular embodiment, detecting an actual current value and an actual grayscale brightness particularly includes: obtaining an actual current value and an actual grayscale brightness for each color, and summing the actual current value for each color and summing the actual grayscale brightness for each color to obtain the actual current value and the actual grayscale brightness of the display panel. Particularly, the blank interval of the display period refers to the post-display compensation period or other time period, in which the detected actual current value and the actual grayscale brightness are fetched or captured as in the related technology.

Particularly, Step 200 includes detecting, in a blank interval of a display period, an actual current value and an actual grayscale brightness of the OLED display panel every preset interval.

It should be noted that, the shorter the preset interval is, the sharper the brightness of the OLED display panel changes, while the longer the preset interval is, the higher the current of the OLED display panel is, and then the screen may be burned.

Preferably, the preset interval is 1 s.

Step 300, determining a target current value by looking up a correspondence between the grayscale brightness and the current according to a target grayscale brightness of the OLED display panel.

Particularly, the target grayscale brightness of the OLED display panel is the ideal grayscale brightness of the OLED display panel.

In a particular embodiment, determining a target current value by looking up the correspondence between the grayscale brightness and the current according to a target grayscale brightness of the display panel includes: determining the target current value of the display panel by looking up the correspondence between the grayscale brightness and the current for each color to determine the target current value for each color, and summing the target current values for each color.

Step 400, adjusting, based on a comparison of the actual current value and the target current value, the actual grayscale brightness so that the actual current value is less than or equal to the target current value.

Particularly, step 400 includes: adjusting the actual grayscale brightness to a product of the actual grayscale brightness and a first ratio in a state where the actual current value is greater than the target current value, or adjusting the actual grayscale brightness to a product of the actual grayscale brightness and a second ratio in a state where the actual current value is less than the target current value. It should be noted that the specific adjustment of the actual grayscale brightness can be changed by changing the externally inputted voltage of the OLED display panel.

Optionally, the first ratio is greater than 0 and less than 1. It should be noted that, since the grayscale brightness is directly proportional to the current value, when the actual current value is greater than the target current value, the actual current is reduced by reducing the actual grayscale brightness, so as to prevent an excessively high actual current value.

Optionally, in order to avoid a human eye perceivable flicker caused by directly reducing the actual grayscale brightness to make the actual current value less than or equal to the target current value, the actual current value may gradually approach the target current value by stepping down the actual grayscale brightness until the actual current value is less than or equal to the target current value to improve the user experience.

Optionally, the second ratio is greater than 0 and less than 1, and the second ratio is greater than the first ratio. It should be noted that, since the grayscale brightness is directly proportional to the current value, the actual current is controlled by controlling the actual grayscale brightness, so as to prevent an excessively high actual current value.

For example, when the actual current value is greater than the target current value, the first ratio 0.8 is selected so that the actual current value is less than the target current value. At this time, the second ratio 0.9 is selected, and then the actual current value is less than the target current value but closer to the target current value than when the first ratio is used.

Particularly, at the beginning of the current control method, the actual current value is less than the target current value. When the OLED display panel is lighted for a period of time, the actual current value will gradually increase. When it is detected that the actual current value is higher than the target current value, the actual grayscale brightness is adjusted to a product of the actual grayscale brightness and the first ratio to reduce the actual grayscale brightness of the OLED display panel. At this time, the actual current value will gradually approach the target current value. When the actual current value is less than the target current value, the actual grayscale brightness is adjusted to a product of the actual grayscale brightness and the second ratio, so as to control the actual grayscale brightness to avoid an excessively high actual current value.

Optionally, the current control method in accordance with an embodiment of the present disclosure further includes: storing the correspondence between the grayscale brightness and the current.

Particularly, the correspondence between the grayscale brightness and the current may be burned into a logic board Tcon of the OLED display panel through a memory chip EEprom that does not lose data after being powered off.

In a particular embodiment, correspondences between the grayscale brightness and the current for various colors or the correspondence between the grayscale brightness and the current for a mixed color may be stored.

Additionally, if the display panel of the embodiment of the present disclosure adopts four colors, before step 100, the current detection method in accordance with the embodiment of the present disclosure optionally further includes: processing the RGB tricolor data to add data for white sub-pixels W and form a design of four color pixels RGBW.

The current control method in accordance with the embodiment of the present disclosure includes: generating a correspondence between grayscale brightness and a current; detecting, in a blank interval of a display period, an actual current value and an actual grayscale brightness of the OLED display panel; determining a target current value by looking up the correspondence between the grayscale brightness and the current according to a target grayscale brightness of the display panel; and adjusting, based on a comparison of the actual current value and the target current value, the actual grayscale brightness so that the actual current value is less than or equal to the target current value. The technical solution of the embodiment of the present disclosure controls the actual grayscale brightness of the OLED display panel so that the actual current value is less than or equal to the theoretical current value, which maintains the stability of the current value, prevents the abnormal increase of the current value, and prevents the OLED display panel from burning its screen.

Figure 4:
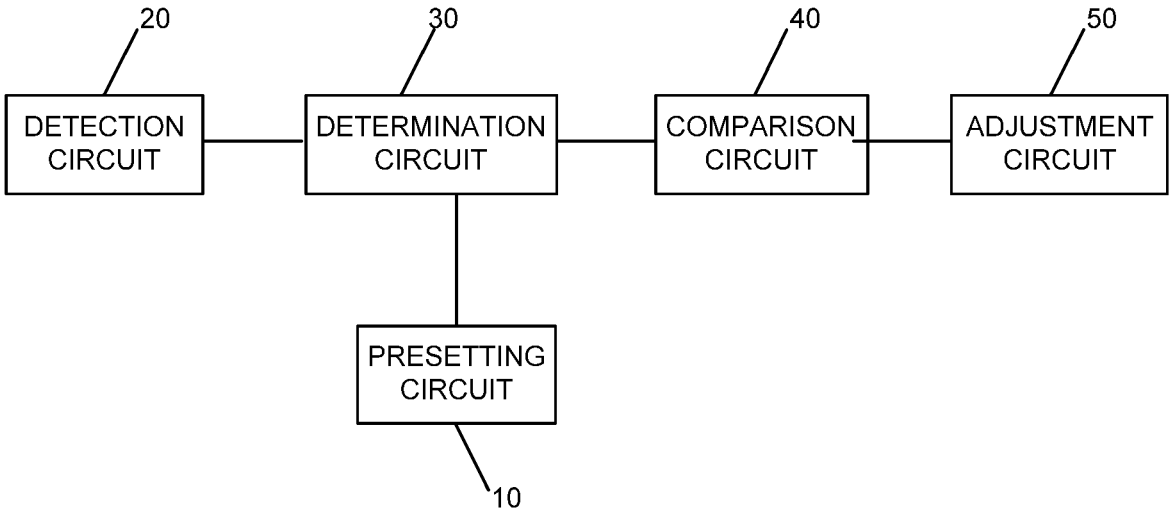
FIG. 4 is a schematic structural diagram of a current control apparatus in accordance with an embodiment of the present disclosure.

Based on the disclosed concepts of the above embodiments, FIG. 4 is a schematic structural diagram of a current control apparatus in accordance with an embodiment of the present disclosure. The current control apparatus is applied to an organic light emitting diode (OLED) display panel. As shown in FIG. 4, the current control apparatus in accordance with the embodiment of the present disclosure includes a presetting circuit 10, a detection circuit 20, a determination circuit 30, a comparison circuit 40, and an adjustment circuit 50.

The presetting circuit 10 is configured to generate a correspondence between grayscale brightness and a current.

The presetting circuit is particularly configured to generate a correspondence between grayscale brightness and a current by: detecting a current value corresponding to a preset grayscale value; calculating grayscale brightness corresponding to a preset grayscale value; generating, according to the current value corresponding to the preset grayscale value and the grayscale brightness corresponding to the preset grayscale value, the correspondence between the grayscale brightness and the current by means of linear fitting.

Particularly, a current value corresponding to a preset grayscale value is detected by an INA226 chip.

Optionally, the number of preset grayscale values is two or more. It should be noted that the greater the number of the preset grayscale values is, the higher the accuracy of the detection is. Taking 1024-level grayscales as an example, the number of the preset grayscale values may be four, for example, and the preset grayscale values may be respectively selected as: 132, 346, 542, and 1023. The present disclosure does not particularly define the number and specific values of the preset grayscale values.

In a particular embodiment, the OLED display panel may include a plurality of sub-pixels displaying at least three colors. Alternatively, if the number of colors is three, the three colors may include: red, blue, and green, i.e., the tricolor. If the number of colors is four, the four colors may include: red, blue, green and white. In addition, the use of four colors, instead of three colors, can reduce the power consumption of the current detection.

In this embodiment, the presetting circuit 10 is particularly configured to generate a correspondence between the grayscale brightness and the current for each of at least three colors. Particularly, the presetting circuit is particularly configured to: detecting a current value corresponding to the preset grayscale value for each of the at least three colors respectively; calculating grayscale brightness corresponding to a preset grayscale value for each color; and generating, according to the current value corresponding to the preset grayscale value for each color and the grayscale brightness corresponding to the preset grayscale value, the correspondence between the grayscale brightness and the current for each color by means of linear fitting.

In a particular embodiment, the presetting circuit 10 is particularly configured to: sum the generated correspondences between the grayscale brightness and the current for each of the at least three colors, so as to obtain a correspondence between the grayscale brightness and the current for a mixed color. For example, a current value corresponding to specific grayscale brightness for each color is summed to obtain a current value corresponding to the specific grayscale brightness, thereby obtaining a correspondence between the grayscale brightness and the current for the mixed color. The correspondence between the grayscale brightness and the current for the mixed color can be used as the correspondence between the grayscale brightness and the current of the OLED display panel displaying a color image.

The detection circuit 20 is configured to detect, in a blank interval of a display period, an actual current value and an actual grayscale brightness of the OLED display panel.

Particularly, the detection circuit 20 is particularly configured to detect, in a blank interval of a display period, an actual current value and an actual grayscale brightness of the OLED display panel every preset interval.

In a particular embodiment, the detection circuit 20 is configured to obtain the actual current value and the actual grayscale brightness for each color, and sum the actual current value and the actual grayscale brightness for each color to obtain the actual current value and the actual grayscale brightness of the display panel.

Particularly, the blank interval of the display period refers to the post-display compensation period or other time period, in which the detected actual current value and the actual grayscale brightness are fetched as in the related technology.

It should be noted that, the shorter the preset interval is, the sharper the brightness of the OLED display panel changes, while the longer the preset interval is, the higher the current of the OLED display panel is, and then the screen may be burned.

Preferably, the preset interval is 1 s.

The determination circuit 30 is configured to determine the target current value by looking up a correspondence between the grayscale brightness and the current according to a target grayscale brightness of the OLED display panel.

Particularly, the target grayscale brightness of the OLED display panel is the ideal grayscale brightness of the OLED display panel.

In a particular embodiment, the determination circuit 30 is configured to determine the target current value of the display panel by looking up the correspondence between the grayscale brightness and the current for each color to determine the target current value for each color, and summing the target current values for each color.

The comparison circuit 40 is configured to compare the actual current value and the target current value.

The adjustment circuit 50 is configured to adjust, based on a comparison of the actual current value and the target current value, the actual grayscale brightness so that the actual current value is less than or equal to the target current value.

The adjustment circuit 50 is particularly configured to adjust the actual grayscale brightness to a product of the actual grayscale brightness and a first ratio in a state where the actual current value is greater than the target current value.

Optionally, the first ratio is greater than 0 and less than 1. It should be noted that, since the grayscale brightness is directly proportional to the current value, when the actual current value is greater than the target current value, the actual current is reduced by reducing the actual grayscale brightness.

The adjustment circuit 50 is particularly configured to adjust the actual grayscale brightness to a product of the actual grayscale brightness and a second ratio in a state where the actual current value is less than the target current value.

Optionally, the second ratio is greater than 0 and less than 1, and the second ratio is greater than the first ratio. It should be noted that, since the grayscale brightness is directly proportional to the current value, the actual current is controlled by controlling the actual grayscale brightness, so as to prevent an excessively high actual current value.

The current control apparatus in accordance with the embodiment of the present disclosure is applied to an organic light emitting diode (OLED) display panel, and includes: a presetting circuit configured to generate a correspondence between grayscale brightness and a current; a detection circuit configure to detect, in a blank interval of a display period, an actual current value and an actual grayscale brightness of the display panel; a determination circuit configured to determine a target current value, by looking up a correspondence between the grayscale brightness and the current according to a target grayscale brightness of the display panel; a comparison circuit configured to compare the actual current value and the target current value; and an adjustment circuit configured to adjust, based on a comparison of the actual current value and the target current value, the actual grayscale brightness so that the actual current value is less than or equal to the target current value. The technical solution according to the embodiment of the present disclosure controls the actual grayscale brightness of the OLED display panel so that the actual current value is less than or equal to the theoretical current value, which maintains the stability of the current value, prevents the abnormal increase of the current value, and prevents the OLED display panel from burning its screen.

Additionally, the current control apparatus in accordance with the embodiment of the present disclosure further includes: a storage circuit.

Particularly, the storage circuit is configured to store the correspondence between the grayscale brightness and the current, and the storage circuit is communicatively connected to the determination circuit and the presetting circuit respectively.

Particularly, the correspondences between the grayscale brightness and the current for four colors are burned into a logic board Tcon of the OLED display panel through a memory chip EEprom that does not lose data after being powered off.

In a particular embodiment, the storage circuit is configured to store correspondences between the grayscale brightness and the current for each of various colors or the correspondence between the grayscale brightness and the current for a mixed color.

The following points need to be explained:

The drawings of embodiments of the present disclosure show only the structures involved in the embodiments of the present disclosure, and one may refer to normal designs for other structures.

In the case of no conflict, the embodiments of the present disclosure (i.e., the features in the embodiments) may be combined with each other to obtain new embodiments.

Figure 5:
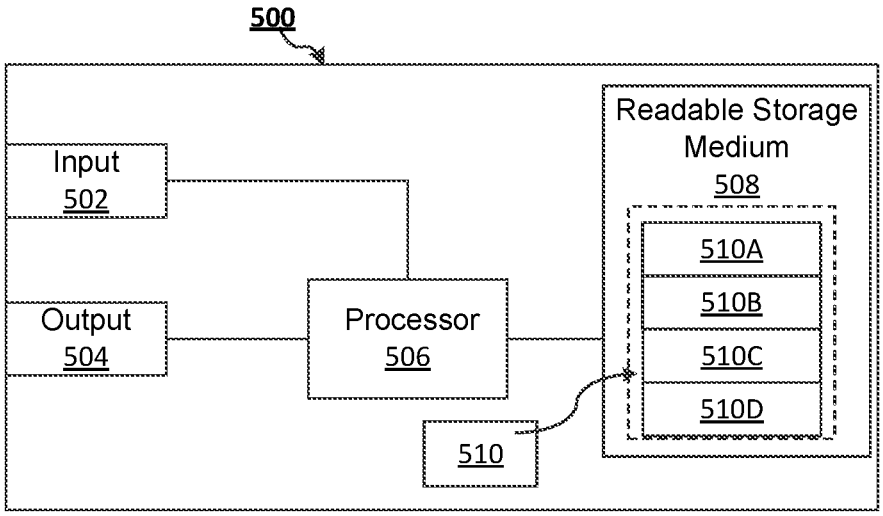
FIG. 5 is a block diagram illustrating an exemplary hardware arrangement of the current control apparatus shown in FIG. 4 in accordance with an embodiment of the disclosure.

FIG. 5 is a block diagram illustrating an exemplary hardware arrangement 500 of the current control apparatus shown in FIG. 4 in accordance with an embodiment of the disclosure. The hardware arrangement 500 may include one or more processors 506 (e.g., a central processing unit (CPU), a digital signal processor (DSP), a microprocessor, a microcontroller, an application specific integrated circuit (ASIC), a programmable logic array ( FPGA), etc.) The arrangement 500 may further include an input circuit 502 for receiving signals from other entities, and an output circuit 504 for providing signals to other entities. The Input circuit 502 and output circuit 504 may be arranged as a single entity or separate entities.

Additionally, the arrangement 500 may include at least one readable storage medium 508 in the form of a non-volatile or volatile memory, such as an electrically erasable programmable read-only memory (EEPROM), a flash memory, and/or a hard disk drive. The readable storage medium 508 may contain a computer program 510 including code/computer-readable instructions that, when executed by the processor 506 in the arrangement 500, cause the hardware arrangement 500 and/or a current control apparatus including the hardware arrangement 500 to be able to perform, for example, the flow described above in connection with FIG. 2 and any variations thereof.

The computer program 510 may be configured as computer program codes having, for example, an architecture of computer program modules 510A-510C. Thus, in an exemplary embodiment where the hardware arrangement 500 is used in a current control apparatus, for example, the codes in the computer program of the arrangement 500 include: a module 510A for generating a correspondence between grayscale brightness and a current. The codes in the computer program further include a module 510B for obtaining an actual current value and an actual grayscale brightness of the display panel. The codes in the computer program further include a module 510C for determining a target current value by looking up a correspondence between the grayscale brightness and the current according to a target grayscale brightness of the display panel. The codes in the computer program further include a module 510D for adjusting, based on a comparison of the actual current value and the target current value, the actual grayscale brightness so that the actual current value is less than or equal to the target current value.

The computer program modules can substantially perform various actions in the flow shown in FIG. 2 to simulate the current control apparatus. In other words, when different computer program modules are executed in the processor 506, they may correspond to the different circuits or modules described above in the current control apparatus.

Although the code means in the embodiment disclosed above in connection with FIG. 5 are implemented as computer program modules, which, when executed in the processor 506, cause the hardware arrangement 500 to perform the actions described above in connection with FIG. 2, in an alternative embodiment, at least one of the code means may be implemented at least partially as a hardware circuit.

The processor may include a general-purpose microprocessor, an instruction set processor, and/or related chipsets and/or dedicated microprocessors. The processor may also include onboard memory for cache purposes. The computer programs may be carried by a computer program product connected to the processor. The computer program product may include a computer-readable medium having a computer program stored thereon. For example, the computer program product may be a flash memory, a random access memory (RAM), a read-only memory (ROM), or an EEPROM, and the computer program modules described above may be distributed among different computer program products in an alternative embodiment.

Although the disclosed embodiments of the present disclosure are described as above, the contents described are merely implementations used for facilitating the understanding of the present disclosure and are not intended to limit the present disclosure. Any person skilled in the art to which the present disclosure pertains may make any modifications and changes to the form and details of implementation without departing from the spirit and scope disclosed in the present disclosure, and the patent protection scope of the present disclosure is defined by the attached claims.

We claim:

1. A current control method comprising:

generating a correspondence between grayscale brightness and a current of a display panel;

detecting, in a blank interval of a display period, an actual current value and an actual grayscale brightness of the display panel;

determining a target current value of the display panel by looking up a correspondence between the grayscale brightness and the current according to a target grayscale brightness of the display panel;

adjusting, based on a comparison of the actual current value and the target current value, the actual grayscale brightness so that the actual current value is less than or equal to the target current value.

2. The method of claim 1, wherein generating the correspondence between grayscale brightness and the current of the display panel comprises:

detecting a current value of the display panel corresponding to a preset grayscale value;

calculating grayscale brightness corresponding to the preset grayscale value; and generating, according to the current value corresponding to the preset grayscale value and the grayscale brightness corresponding to the preset grayscale value, the correspondence between the grayscale brightness and the current by linear fitting.

3. The method of claim 2, wherein a number of the preset grayscale values is two or more.

4. The method of claim 1, wherein detecting, in the blank interval of the display period, the actual current value and the actual grayscale brightness of the display panel comprises:

detecting, in the blank interval of the display period, the actual current value and the actual grayscale brightness of the display panel at every preset interval.

5. The method of claim 1, wherein adjusting, based on a comparison of the actual current value and the target current value, the actual grayscale brightness comprises:

adjusting the actual grayscale brightness to a product of the actual grayscale brightness and a first ratio in a state where the actual current value is greater than the target current value, wherein the first ratio is greater than 0 and less than 1.

6. The method of claim 5, wherein adjusting, based on a comparison of the actual current value and the target current value, the actual grayscale brightness comprises:

adjusting the actual grayscale brightness to a product of the actual grayscale brightness and a second ratio in a state where the actual current value is less than the target current value, wherein the second ratio is greater than 0 and less than 1, and wherein the second ratio is greater than the first ratio.

7. The method of claim 1, wherein the display panel is an OLED display panel.

8. The method of claim 1, wherein:

generating the correspondence between the grayscale brightness and the current of the display panel further comprises: generating correspondences between the grayscale brightness and the current for each of at least three colors; and detecting an actual current value and an actual grayscale brightness of the display panel comprises: obtaining an actual current value and an actual grayscale brightness for each color, and summing the actual current value and the actual grayscale brightness for each color to obtain the actual current value and the actual grayscale brightness of the display panel; and determining a target current value by looking up the correspondence between the grayscale brightness and the current according to a target grayscale brightness of the display panel comprises: determining the target current value of the display panel by looking up the correspondence between the grayscale brightness and the current for each color to determine the target current value for each color, and summing the target current values for each color.

9. A current control apparatus comprising:

a presetting circuit configured to generate a correspondence between grayscale brightness and a current of a display panel;

a detection circuit configure to detect, in a blank interval of a display period, an actual current value and an actual grayscale brightness of the display panel;

a determination circuit configured to determine a target current value of the display panel by looking up a correspondence between the grayscale brightness and the current, according to a target grayscale brightness of the display panel;

a comparison circuit configured to compare the actual current value and the target current value; and an adjustment circuit configured to adjust, based on a comparison of the actual current value and the target current value, the actual grayscale brightness so that the actual current value is less than or equal to the target current value.

10. The apparatus of claim 9, wherein the presetting circuit is configured to generate the correspondence between grayscale brightness and the current of the display panel by:

detecting the current value of the display panel corresponding to a preset grayscale value;

calculating grayscale brightness corresponding to the preset grayscale value; and generating, according to the current value corresponding to the preset grayscale value and the grayscale brightness corresponding to the preset grayscale value, the correspondence between the grayscale brightness and the current by linear fitting.

11. The apparatus of claim 10, wherein a number of the preset grayscale values is two or more.

12. The apparatus of claim 9, wherein the detection circuit is configure to detect, in the blank interval of the display period, the actual current value and the actual grayscale brightness of the display panel at every preset interval.

13. The apparatus of claim 9, wherein the adjustment circuit is configured to adjust the actual grayscale brightness to a product of the actual grayscale brightness and a first ratio in a state where the actual current value is greater than the target current value, wherein the first ratio is greater than 0 and less than 1.

14. The apparatus of claim 13, wherein the adjustment circuit is configured to adjust the actual grayscale brightness to a product of the actual grayscale brightness and a second ratio in a state where the actual current value is less than the target current value, wherein the second ratio is greater than 0 and less than 1, and wherein the second ratio is greater than the first ratio.

15. The apparatus of claim 9, wherein the display panel is an OLED display panel.

16. The apparatus of claim 9, wherein:

the presetting circuit is further configured to generate a correspondence between the grayscale brightness and the current for each of at least three colors;

the detection circuit is further configured to obtain an actual current value and an actual grayscale brightness for each color, and sum the actual current value and the actual grayscale brightness for each color to obtain the actual current value and the actual grayscale brightness of the display panel; and the determination circuit is further configured to determine the target current value of the display panel by looking up the correspondence between the grayscale brightness and the current for each color to obtain the target current value for each color, and summing the target current values for each color.

* * * * *